United States Patent [19]

Misencik et al.

[11] 4,409,574

[45] Oct. 11, 1983

[54] GROUND FAULT CIRCUIT INTERRUPTER WITH A UNIFIED TEST AND RESET SWITCH MECHANISM

[75] Inventors: John J. Misencik, Shelton; Alden K. Clements, Stratford, both of Conn.

[73] Assignee: Westinghouse Electric Corp., Pittsburgh, Pa.

[21] Appl. No.: 342,025

[22] Filed: Jan. 21, 1982

[51] Int. Cl.[3] ..... H01H 73/22

[52] U.S. Cl. ..... 335/18; 335/42

[58] Field of Search ..... 335/18, 42

[56] References Cited

U.S. PATENT DOCUMENTS 3,440,579 4/1969 Smith ..... 335/18

4,010,431 3/1977 Virani et al. ..... 335/18

*Primary Examiner*—Harold Broome

*Attorney, Agent, or Firm*—G. H. Telfer

[57] ABSTRACT

The mechanism is operable by a single test/reset push button whose initial travel from a normal operating position causes closing of test circuit contacts while power contacts are engaged. Upon an actual or test trip actuating the trip solenoid of the interrupter, a latch member releases a member holding movable power contacts and also extends the push button out due to spring action to indicate the occurrence of the trip. For resetting, the same button is again pushed to reengage the power contacts in a closed position after which release of the button returns it to its normal operating position in which the mechanism is latched.

7 Claims, 6 Drawing Figures

RESET

TRIPPED

GROUND FAULT CIRCUIT INTERRUPTER WITH A UNIFIED TEST AND RESET SWITCH MECHANISM

BACKGROUND AND SUMMARY OF THE INVENTION

This invention relates to ground fault circuit interrupters, particularly those for personnel protection.

Ground fault circuit interrupters for personnel protection are required in normal practice to be subject to periodic testing to confirm operability. This is implemented by a test circuit branch extending between the hot line conductor on the load side of the sensing transformer of the unit to the neutral conductor on the supply side of the sensing transformer. The test circuit branch comprises a current limiting resistor and also a switch operated by a test button. The test switch is normally open but when the button is depressed and the switch is closed the unit sees a simulated ground fault which should result in a trip and, if not, indicates the device or the manner of its installation is faulty. There is further provided a reset button which is operable after actuation of the test button and the resulting trip to reset the unit to its normal standby condition for operation.

Virani et al. U.S. Pat. No. 4,010,431, Mar. 1, 1977, is representative of a ground fault interrupter, particularly in a receptacle, with provision for a test switch and its operation by a test button and a reset button. The illustrative embodiment shown in the Virani et al. patent is one in which the power contacts operate off a rocking plate (FIG. 6, contact plate 41). In common with other known practice, including those in which the power contacts operate off of a lifting plate, rather than a rocking plate, this device requires separate test and reset buttons for sequentially testing a unit and restoring it to operative condition. All such units are subject to certain defects or drawbacks in their operation. These have to do with the possibility of improper usage of the test and reset buttons that permit what is referred to as "teasing" in which both buttons are simultaneously depressed or are depressed in rapid sequence. Under such conditions it is possible for the unit to be on and conducting to downstream loads while it is disabled from tripping if a ground fault does occur near one of the loads. This is regarded as a highly unlikely combination of circumstances but it may be preferable to have a unit that is not subject to such user abuse and which performs in a trip-free manner at all times. By trip-free is meant the unit will trip any time a ground fault occurs even if the test switch is somehow being manually manipulated in an improper manner.

The present invention achieves the basic purposes of preventing teasing and permitting trip-free operation at all times by unifying the test button and reset button functions, heretofore separately provided, into a unitary mechanism assembly operable by a single manually operable element, such as a push button (referred to herein as a test/reset button or T/R button), that permits initial operation of a test function and then an operation of the reset function only upon completion of the test function. The general construction of this unified test and reset mechanism is one in which a single push button, or other manually operable force applying element, is arranged in a combination with spring elements, contact elements and stop elements so that there are four characteristic positions taken by the mechanism at various stages of operation. In each of the four positions the unit is either on and subject to trip-free operation or is off and immune from the occurrence of a downstream ground fault.

Briefly, the four positions, and their relation to the operative mechanism, are:

A first, latched position, which is the normal standby or operating condition of the unit that permits energization of a load from a supply. The unit is armed for tripping actuation upon occurrence of a ground fault. In the latched position, before any ground fault has occurred, the T/R button is in its normal position which may be generally flush with the surface of the unit and is latched in that position by latch means. Spring means maintain power contacts communicating to the load in a closed position. Test contacts for operation of the test circuit branch are in an open position when the unit is latched.

A second, test position, resulting from a first depression of the T/R button from the latched position which results in the closing of the test contacts while the power contacts remain closed. If the device or its installation are faulty the consequence of moving the button to the test position and releasing it is informative of the defect. The unit returns to the latched position, a trip has not occurred, and the absence of such a trip informs the user that the test was negative. However, in the event of a positive, successful, test, the movement of the T/R button from the latched to the test position causes a ground fault trip signal to be generated and a trip solenoid moves the latch holding the power contacts closing resulting in opening of the power contacts so that the mechanism is now in the third or tripped position.

In the third or tripped position after the release of the latch means, spring elements have caused opening of both the power contacts and the test contacts. The T/R button has moved outwardly to its maximum outward position, though retained in place by a stop means. In its maximum outward tripped position the button indicates to the user that a trip has occurred. This may be by the extent to which the button protrudes from the face of the unit or, preferably, by indicia disposed on a surface of the button such as the side of a pushbutton indicating by a red stripe or other means that only becomes visible upon reaching the tripped position that a trip has occurred.

A fourth, reset position, is one in which the T/R button is again depressed by the user after a trip to a point at which the test contacts again close and are closed upon initially making contact between the power contacts. When the force on the T/R button is withdrawn, the spring means cause outward movement of the elements and the latch means again latches the power contacts closed. The outward movement also releases the test contacts and the unit has returned to the initial latched position for operation.

DESCRIPTION OF THE PREFERRED EMBODIMENTS

Figure 1:
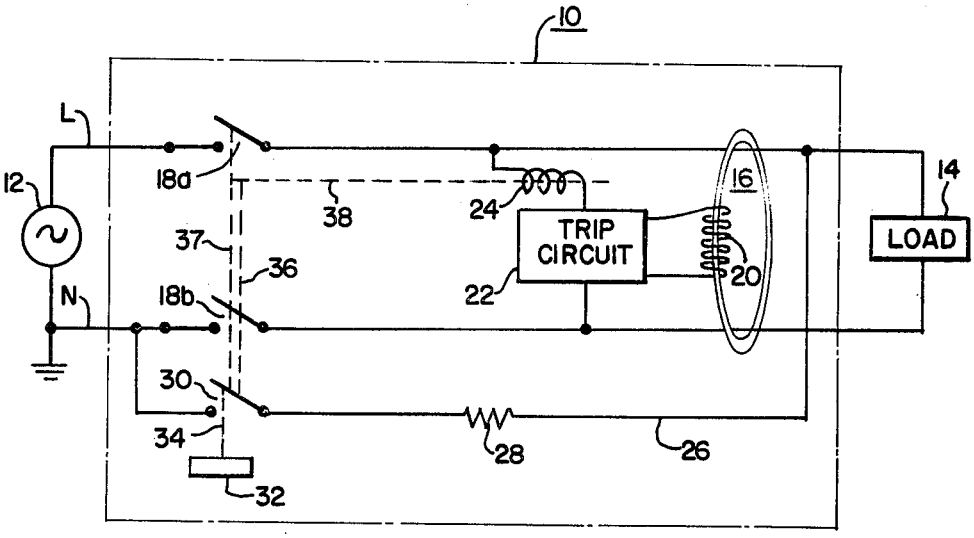
FIG. 1 is a schematic circuit diagram of an embodiment of the present invention.

Referring to FIG. 1, a ground fault circuit interrupter (GFCI) 10 in accordance with the present invention is schematically illustrated connected between an AC supply 12 and a load 14. The system depicted assumes a usual single phase, two wire system in which the distribution conductors are identified as a hot line L and a neutral conductor N, the latter being conducted to the grounded side of the supply. Conductors L and N extend to the load through the GFCI to which they are connected on each side of the unit. In the unit with which the present description will be directed it is the case that a ground fault receptacle is contemplated in which the load is associated with the ground fault unit through a male plug and female socket connection, as is usual. The GFCI has a usual sensor transformer 16 through which conductors L and N extend as primary windings. It also has interrupter contacts 18*a* and 18*b* in the conductors L and N, respectively, for interruption of the circuit upon occurrence of a ground fault. Some applications would require interrupter contacts only in conductor L. A trip is performed when a secondary winding 20 on the sensor transformer 16 develops a signal indicating an imbalance between the currents on L and N and a sense amplifier and trip circuit 22 actuates a solenoid coil 24 which results in the opening of the trip contacts 18.

The apparatus may also include, as in conventional, some sort of grounded neutral protection means to result in opening of the circuit interrupting contacts 18*a* and 18*b* upon occurrence of a grounded neutral on the load side of the sensor transformer 16.

The apparatus 10 further includes a test circuit branch 26 extending from conductor L on the load side of transformer 16 to the supply side of conductor N. The test circuit branch 26 includes a current limiting resistor 28 and a manually operable test switch 30. In accordance with this invention, a combined test and reset switch mechanism acutable by a single manually operable element, such as a push button 32, is devised in a manner to permit all aspects of required operation as opposed to the separate test and reset buttons used in prior configured apparatus such as that in accordance with U.S. Pat. No. 4,010,431.

For schematic purposes, the single test and reset button 32 is shown in FIG. 1 having a mechanical linkage 34 with the test switch 30 and through further mechanical elements 36 with the power contacts 18*a* and 18*b* in the conductors L and N which are also related to each other and to the trip solenoid by elements 37 and 38, respectively.

FIGS. 2–5 show an actual embodiment of a test and reset mechanism in accordance with this invention. Each of FIGS. 2–5 show the same elements but in different positions respectively corresponding to those referred to in the introductory portion of the specification as the first or latched position, the second or test position, the third or tripped position, and the fourth or reset position.

Among the several elements of the mechanism as shown in FIGS. 2–5 are several that can be directly correlated with elements of FIG. 1. The power contacts 18*a* and 18*b* of FIG. 1 are shown as two pairs of contacts 40–41 and 42–43 in the generally symmetrical configuration. Each of the two pairs includes a stationary contact 40 and 42 and a movable contact 41 and 43 of which the movable contacts 41 and 43 are mounted on a single element 44, referred to as a commutator, which mechanically unites them while maintaining electrical insulation therebetween. Conductive members 50, 51, 52 and 53 communicate directly with the contact elements 40, 41, 42 and 43, respectively, and serve as parts of conductor L (e.g. 50–51) and conductor N (e.g. 52–53). For convenience in the following description, the power contacts may be referred to as stationary contact 40 and movable contact 41, it being understood contacts 42 and 43 are correspondingly arranged and operated.

Test contacts, including one stationary contact 33 and one movable contact 54, are shown and are to be connected in the test circuit branch 26 indicated in FIG. 1 where test switch 30 is shown.

Various elements of the assembly that are fixed in position relative to each other and to the housing of the unit will now be referred to. They include the device housing or cover 56, an internally adjacent support member 58 which has several functions including the support of the stationary power contacts 40 and 42, a further internal housing partition element 60 which has a purpose of acting as a stop means for limiting the travel of the commutator 44 bearing the movable power contacts, and the stationary test contact 33 and its support 62.

The various elements and others to be referred to will be best understood through description of the various views as the device is operated.

Figure 2:
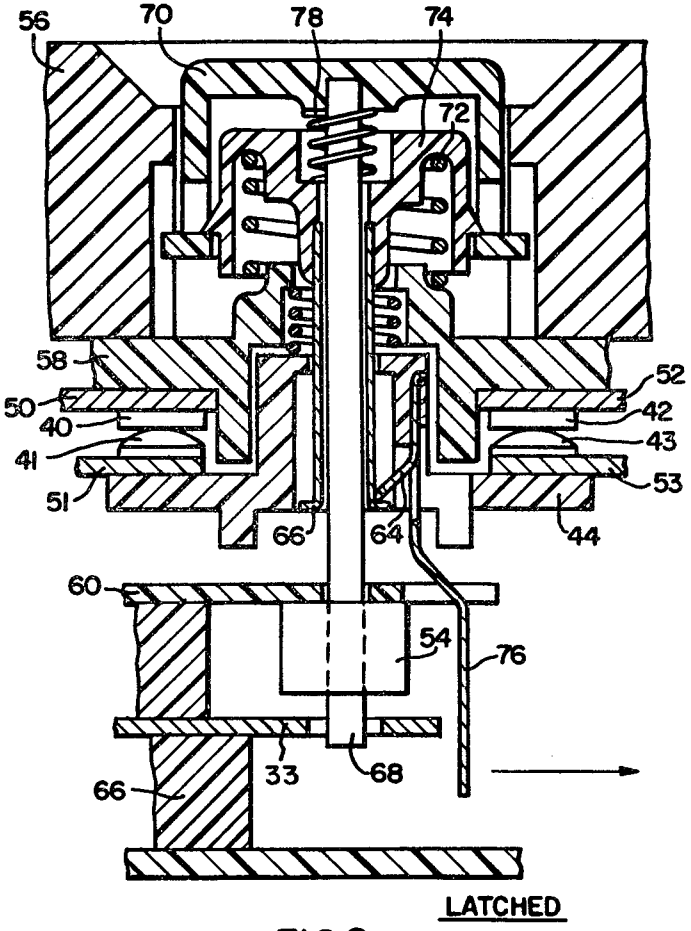

The view of FIG. 2 is arbitrarily taken as the first position as it is the normal position of the elements when the unit 10 is connected for the supply of a load and monitoring of ground faults in connection with such load. This is the latched position. It is referred to as the latched position because the power contacts 40–41 are closed and held closed by a latch means that in this embodiment includes a latch hook 64 that is engaged with a flange-like element on a sleeve 66 that extends around a centrally located shaft 68 referred to as the test shaft. In the position as shown in FIG. 2, before any movement of the test/reset (T/R) button 70, the power contacts 40–41 are mechanically held against separation and the test contacts 33–54 are open by reason of the fact a main spring 72, the most powerful spring element in the assembly, forces internal button 74 outwardly and with it the shaft 68 and sleeve 66 which bears up against latch hook 64.

The latch means includes a flexible latch member 76 joined at one end to commutator 44 and extending for some length, downwardly in this view, away from the latch hook 64 and from the end at which the latch member is affixed within the commutator. The latch member 76 free end is under the influence of a solenoid operable by the coil 24 depicted in FIG. 1 in such a manner that the operation of the solenoid, in response to a ground fault signal, pulls the free end of the latch plate member 76 laterally in the direction of the arrow so that the latch hook 64 is released and the power contacts are opened under the influence of springs within the structure. This would cause the structure to go immediately to the tripped position without a test operation. So it is to be understood that the views presented here with respect to the various positions are not necessarily views that must be achieved in sequence in the operation of the device.

Figure 6:
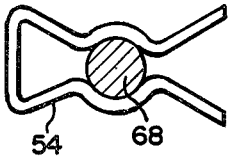
FIG. 6 is a plan sectional view of certain elements of the device of FIGS. 2–5.
Figure 3:
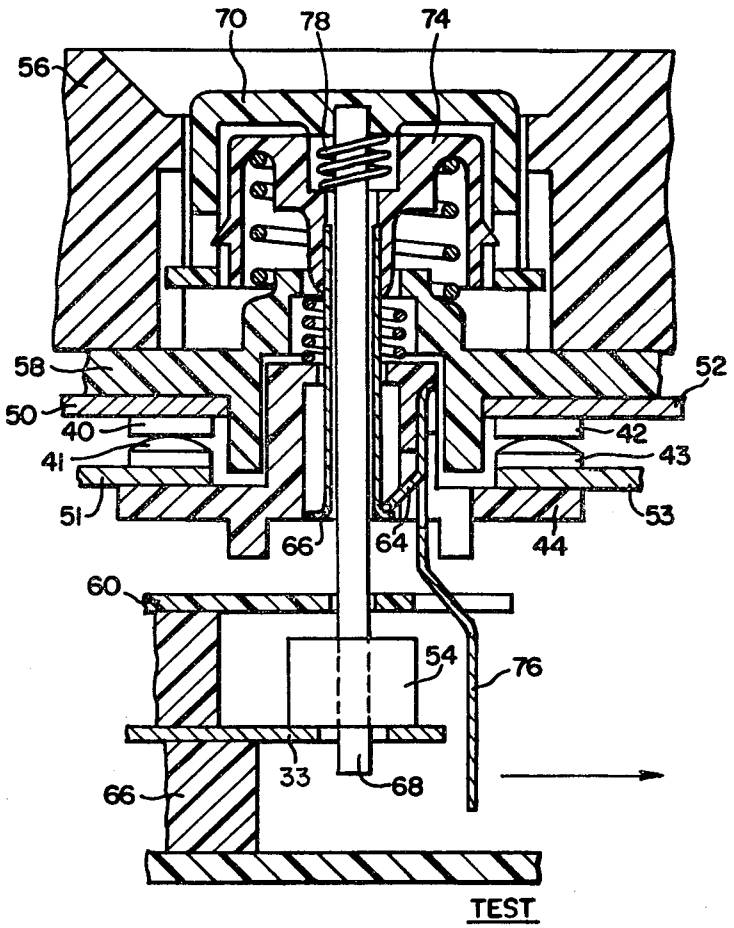
FIGS. 2–5 are cross-sectional elevation views of a test and reset mechanism in accordance with an embodiment of the invention as may be used in the combination shown in FIG. 1.

When a user operates the test switch 30 he depresses the test/reset button 70 to cause movement of the elements from the position in which they are shown in FIG. 2 to the position in which they are shown in FIG. 3. The pressure on the button 70 compresses a relatively light test spring 78 and carries downwardly with it the test shaft 68 with its attached test sliding contact 54. The sliding contact 54 is slidably attached to the test shaft 68 with a light frictional fit, see FIG. 6. That is, within certain limits, the movable test contact not only moves into and out of engagement with the stationary test contact, it also moves longitudinally in relation to the test shaft on which it is mounted, as will be seen in subsequent views.

Figure 4:
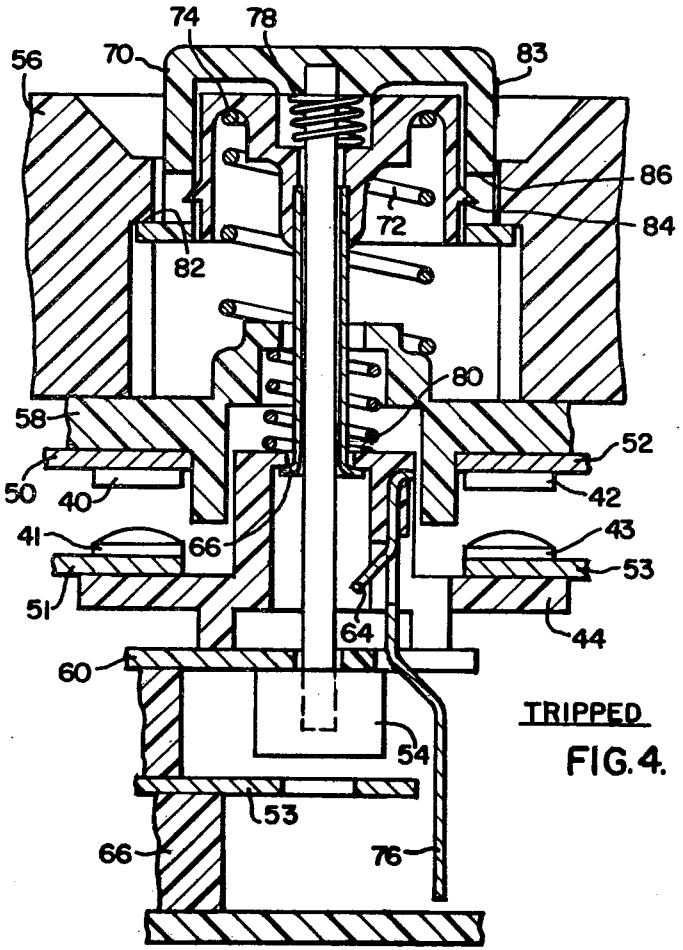

For a test to be performed the button 70 must be pushed sufficiently for the test sliding contact 54 to reach the stationary test contact 33 as shown in FIG. 3. This either results in no actuation indicating a defect or it results in simulation of a ground fault for the circuit of FIG. 1 and operation of the solenoid which causes the latch lever 76 to be pulled laterally and the latch hook 64 released. This translates the assembly into the position as indicated in FIG. 4, the tripped position. Here the latch hook 64 has become disengaged from the head of the reset sleeve 66 which otherwise holds it and that has allowed a commutator spring 80 to expand downwardly forcing the commutator 44 to move and to open the power contacts 40–41. The commutator 44 is free to continue moving downwardly until it makes contact and stops against the commutator stop element 60 and in such a position creates a controlled gap between the contacts 40–41. At the same time, after release of the latch hook 64, main spring 72 is free to expand upwardly carrying with it the internal button 74 and the sleeve 66 that are joined with button 74, sliding test contact 54 on shaft 68, and the test button 70 itself. For this purpose it is apparent the main spring has more force upon its release than does the test spring 78.

This assembly travels upwardly until the T/R button 70 stops at a point 82 where it is limited by a shoulder in the housing. The internal button 74 bottoms upwards against the button 70 and also stops so that both buttons and their associated shaft 68 and sleeve 66 are stopped in this position. In this tripped position there is afforded visual indication in the form of some indicia 83 on the T/R button 70, such as a red stripe that is now visible above adjacent surface of the housing cover. This may also be accomplished by red material of the internal button 74 showing through slots in sides of the test button 70. In the tripped position the unit is of course inoperative and downstream loads are not being supplied. Whether this condition results from a ground fault trip that has actually occurred or from the test operation is immaterial as the unit will require resetting to become fully operational again.

Figure 5:
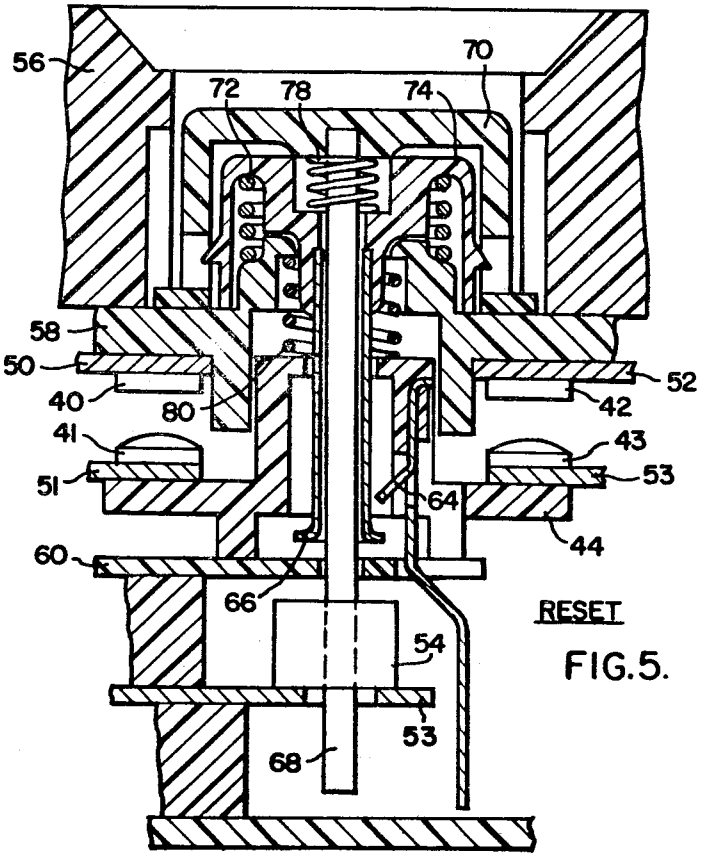

For the reset to occur the T/R button 70 is again depressed from the position shown in FIG. 4 until it reaches the position shown in FIG. 5. Here the inside button 74 is carried along with the test button 70 until both buttons stop against the partition member 58. At this time the head of the reset sleeve 66 has already snapped below the latch hook 64 and is ready to draw upwards when the buttons are released, raising the entire commutator assembly thereby closing the contacts 40–41 again and returning the assembly to the position as shown in FIG. 2. This upward motion is induced by the main spring 72 which forces the buttons upward to the extent permitted by the latch on the sleeve. Sliding test contact 54 is drawn upwards against the underside of the fixed element 60 and again restores the test gap between the test contacts so that the unit is now ready for the next test operation.

When the upward travel of the inner and outer buttons 74 and 70 has stopped, the remaining short travel of the button 70 in relation to the inner button 74 is created by the test spring 78 only, during which travel the test shaft 68 is pulled upwardly to a point where there is again a short gap created between the two buttons, as shown in FIG. 2, which allows the travel for a subsequent test operation to occur. The position of the two buttons 70 and 74 relative to each other is maintained by the ratchet tooth configuration 84 on button 74 and its associated slots 86 in the button 70. The button assembly when released returns to their original position shown in FIG. 2.

It will be seen from FIG. 5 that during the reset operation the test contacts 33 and 54 close while the power contacts 40 and 41 are still open. A test operation does not happen at that time. However, the sliding test contact 54 is pushed upward on shaft 68 so that when the buttons 70 and 74 are released and return to the latched position (FIG. 2), there is adequate clearance between contacts 33 and 54 so an inadvertent test and trip does not occur. The slidably mounted test contact 54 is beneficial for permitting the test and reset mechanism of this invention to be made in a compact form for incorporation in receptacles.

The assembly is therefore one in which test and reset functions are performed by operation of a single button 70 in two successive operations and without incurring any risk of having the unit on and being disabled from reacting to a ground fault. Completely trip free operation is therefore achieved.

We claim:

1. A ground fault circuit interrupter comprising:

means for interrupting applied power to a load upon occurrence of a ground fault by opening a pair of power contacts;

a test circuit branch, including a pair of test contacts, connected to simulate a ground fault when said test contacts are closed;

a test and reset mechanism for testing said interrupter means to determine its operability and for resetting said interrupter means after it has performed a ground fault or test trip;

said mechanism comprising a single manually operable force applying element accessible on the exterior of the interrupter, latch and spring means for holding said force applying element at a first, latched, position in normal operation in which said power contacts are closed and said test contacts are open, means responsive to a first externally applied movement of said single manually operable force applying element for sequentially achieving second and third positions of which said second position is a test position in which said power contacts are closed and said test contacts are also closed, and said third position is a tripped position in which the release of said latch and spring means has occurred and said power contacts are open, means responsive to a second externally applied movement of said single manually operable force applying element for achieving a fourth position which is a reset position in which said power contacts are open and said test contacts are closed, and after achieving said fourth position said mechanism returns to said first, latched, position.

2. The subject matter of claim 1 wherein:

said single manually operable force applying element is a push button that has stable positioning when said mechanism is in either of said first, latched, or third, tipped, positions and which upon application of depressive force in said first position moves sequentially to said second and third positions and upon application of depressive force in said third position moves sequentially to said fourth and first positions.

3. The subject matter of claim 2 wherein:

said test and reset mechanism further comprises a first test spring for holding said test contacts apart except in response to a depressive force on said push button and for compressing and forcing said test contacts to close by moving a test shaft member carrying a movable test contact until said movable test contact closes with a stationary test contact, wherein activation of the interrupter occurs to release said latch and spring means, a second commutator spring which forces downwardly a commutator to open said power contacts upon release of said latch and spring means, and a third main spring which forces outwardly said push button upon release of said latch and spring means to give visual indication of occurrence of a trip.

4. The subject matter of claim 3 wherein:

said push button has a visual indicator on a surface thereof that is visible to indicate said push button is in said third, tipped, position only upon said third, main, spring has forced said button outwardly to the maximum extent and both said power and test contacts are open.

5. The subject matter of claim 1 wherein:

said latch and spring means directly responds to actuation of a solenoid by a ground fault or test trip to achieve said tripped position.

6. The subject matter of claim 1 wherein:

said test and reset mechanism comprises an outer test/reset push button that is accessible for manual operation and is said single manually operable force applying element, a shaft fixed to and extending inwardly from said push button, a movable test contact element that is one of said pair of test contacts, mounted on said shaft for movement therewith, an inner button element located inwardly from said push button and disposed with said shaft running therethrough, a sleeve encircling said shaft and affixed at its upper end to said inner button element, a laterally extending flange element at the lower end of said sleeve, a test spring encircling said shaft between said push button and said inner button, a fixed contact support member located below and stopping inward travel of said push button and said inner button, at least one fixed power contact, that is one of said pair of power contacts, on said fixed contact support member, a main spring located between said inner button and said fixed contact support member, said main spring being more powerful than said test spring, a commutator member below said fixed contact support member, at least one movable power contact, that is the other of said pair of power contacts, supported on said commutator member and engageable with said at least one fixed power contact, a latch member having an end affixed to said commutator member and having a latch hook engageable with said flange element of said sleeve on the upper side of said flange element, a commutator spring located between said fixed contact support member and said commutator member, said commutator spring forcing said commutator downwardly, and a fixed test contact, that is the other of said pair of test contacts and is engageable with said movable test contact element, located below said movable test contact element.

7. The subject matter of claim 6, wherein:

said movable test contact element is slidably mounted on said shaft in a friction fit so the position of said contact element is adjusted during the course of operation by fixed elements of the assembly.

* * * * *